United States Patent [19]

Takai

[11] 4,355,499

[45] Oct. 26, 1982

[54] FABRICS HAVING SALT-AND-PEPPER PATTERNS AND CRIMPED FILAMENT YARNS FOR PRODUCING THE SAME

[75] Inventor: Isao Takai, Komatsu, Japan

[73] Assignee: Oda Gosen Kogyo Kabushiki Kaisha, Komatu, Japan

[21] Appl. No.: 131,314

[22] Filed: Mar. 18, 1980

[30] Foreign Application Priority Data

May 16, 1979 [JP] Japan ..... 54-59094
May 16, 1979 [JP] Japan ..... 54-59095

[51] Int. Cl.[3] ..... D02G 3/26; D02G 3/34; D02G 3/40

[52] U.S. Cl. ..... 57/205; 57/208; 57/284; 57/286; 139/426 TW

[58] Field of Search ..... 57/204, 205, 208, 209, 57/246, 247, 250, 284, 286; 139/426 TW

[56] References Cited

U.S. PATENT DOCUMENTS 3,978,647 9/1976 Kosaka et al. ..... 57/205
4,033,103 7/1977 Vukoje ..... 57/205 X
4,084,622 4/1978 Nakagawa et al. ..... 57/208 X
4,103,481 8/1978 Vukoje ..... 57/205

FOREIGN PATENT DOCUMENTS 52-141585 2/1977 Japan ..... 57/205

*Primary Examiner*—Donald Watkins
*Attorney, Agent, or Firm*—David G. Alexander

[57] ABSTRACT

A yarn having a number of filaments is passed through between intercrossing work surfaces of two intercrossing endless belts which run in pressing engagement with each other. By suitably selecting the intercrossing angle of the belts, tension acting on the yarn and heater temperature, a crimped filament yarn is prepared having S-twist and Z-twist portions distributed in alternation along the length of the filament yarn. The filaments are tightly engaged with each other in the S-twist (or Z-twist) portions while being separated from one another in the Z-twist (or S-twist) portions. A fabic using such crimped yarn is dyed to cause the tightly bound portions to appear in a dark shade of color and the loosely bound portions in a light shade, thereby producing a salt-and-pepper pattern.

8 Claims, 7 Drawing Figures

FABRICS HAVING SALT-AND-PEPPER PATTERNS AND CRIMPED FILAMENT YARNS FOR PRODUCING THE SAME

BACKGROUND OF THE INVENTION

The present invention relates to knitted or woven fabrics having salt-and-pepper patterns and crimped filament yarns for producing the same.

Fabrics with salt-and-pepper patterns are known which have different shades of color. To provide such a pattern on a fabric, a filament yarn itself needs to undergo structural transformation along the lengthwise direction such that the filament yarn has different shades of color in said direction during dyeing of the fabric. Conventionally, use is made of a heating roller formed with teeth and supplied with a crimped filament yarn prepared by a spindle system type false-twisting apparatus or the like. Portions of the filament yarn engaged with the heating roller are heated thereby to produce an uncrimped or drawn state. When a fabric consisting of such processed yarn or yarns is dyed, the uncrimped portions of the yarn have a dark shade and the crimped portions a light shade so that the fabric as a whole is formed with a salt-and-pepper pattern theron.

Since however the uncrimped portions occur at equal distances along the filament yarn due to the use of the toothed heating roller, the pattern on the dyed fabric has a linear and regular configuration such as one resembling a tortoise shell. The fabric therefore fails to attain a salt-and-pepper pattern which has dark and light areas scattered uniformly over the entire surface of the fabric.

Moreover, a known process of the type described requires an additional step of treating the filament yarn after the false twisting. Though an attempt has been made to provide different structures to a filament yarn along the length simultaneously with the false twisting, difficulty has been experienced with the conventional spindle type system due to considerable tension which acts on the filament yarn when the latter is drawn out from the spindle.

SUMMARY OF THE INVENTION

An object of the present invention is to provide a knitted or woven fabric whose entire surface has an evenly distributed salt-and-pepper pattern.

Another object of the present invention is to provide a filament yarn suitable for preparing such a fabric.

A further object of the present invention is to provide a method of preparing a filament yarn suitable for the production of such a fabric.

A fabric with a salt-and-pepper pattern embodying the present invention is made up of a crimped filament yarn or yarns each consisting of a number of filaments in alternating S- and Z-twists. The filaments of each yarn are bound tightly together in S-twist (or Z-twist) portions while being separated from one another in Z-twist (or S-twist) portions. When dyed, the tight and loose yarn portions constituting the fabric appear in dark and light shades, respectively.

DETAILED DESCRIPTION OF THE PREFERRED EMBODIMENTS

Reference will now be made to the accompanying drawings for describing crimped filament yarns for producing a fabric according to the invention and the dyeing thereof.

Figure 1:
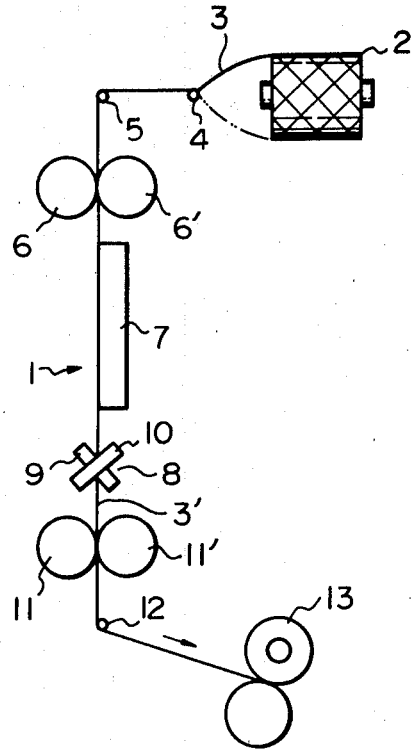
FIG. 1 schematically illustrates a false-twisting system applicable to the production of a crimped filament yarn for producing a fabric according to the present invention.

FIG. 1 schematically illustrates a false-twisting system applicable to the production of crimped yarns for producing a fabric of the invention. With this system generally designated as 1, a filament yarn 3 such as a thermoplastic synthetic filament yarn is wound on a bobbin 2 and drawn out therefrom to a pair of feed rollers 6 and 6' through guides 4 and 5. The feed roller pair 6 and 6' advances the filament yarn to a heating unit 7 and then to a false twister assembly 8. Described in detail in my U.S. Pat. No. 4,047,373, the false twister assembly 8 employs two endless belts 9 and 10 movable in opposite directions in pressing engagement with each other. The processed portion 3' of the filament yarn is pulled by a pair of rollers 11 and 11' out of the false twister 8 wherefrom it is wound around a take-up roller 13 via a guide 12.

Using a system having the construction shown in FIG. 1, I performed false-twisting on a filament yarn under the conditions discussed hereinafter.

Figure 2:
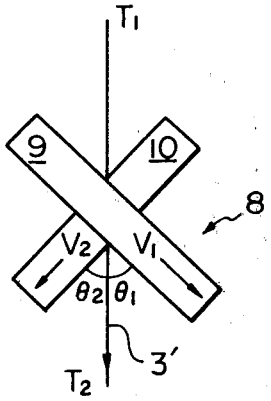
FIG. 2 is a diagram explanatory of an advancing component and a twisting component provided by running belts.

Let it now be assumed that as seen in FIG. 2 the belts 9 and 10 are driven to run at velocities $V_1$ and $V_2$ and that the belts 9 and 10 and processed filament yarn 3' define angles $\theta_1$ and $\theta_2$ therebetween. These angles $\theta_1$ and $\theta_2$ were commonly preset smaller than 45° so that a feeding component of velocity $V_Y$ acting on the filament yarn as a result of the travel of the belts ($V_Y = V_1 \cos\theta_1$, $V_2 \cos\theta_2$) was larger than a twisting velocity component $V_T$($V_T = V_1 \sin\theta_1$, $V_2 \sin\theta_2$). Usually, the relations $V_1 = V_2$ and $\theta_1 = \theta_2$ should preferably be maintained to promote ease of operation.

Meanwhile, the rotating velocities of the feed roller pair 6, 6' and pull-out roller pair 11, 11' were selected such that a tension $T_2$ imparted to the filament yarn downstream of the false twister was smaller than a tension $T_1$, preferably $\frac{1}{2}T_1$, on the same yarn upstream of the false twister. The downstream tension $T_2$ is desired to be relatively small in order that twists remain on the processed filament yarn; a preferable range is $0\ g < T_2 < 20\ g$.

Regarding the heater 7, its treating temperature was somewhat higher than the melting point of the thermoplastic filaments of the yarn 3 thereby causing the latter to be partly fused together. It will be understood that the preferable temperature range of the heater 7 depends on the yarn feed velocity and overall length of the heater 7 as well as the material constituting the filament yarn.

Figure 3:
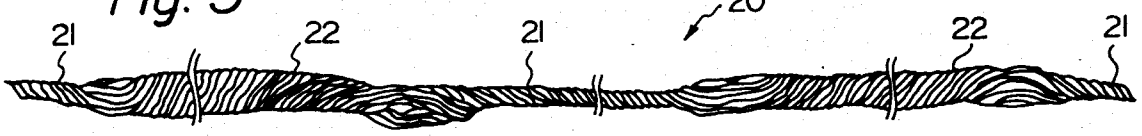
FIG. 3 is a microphotographic sketch of a crimped filament yarn prepared in accordance with the invention.
Figure 4:
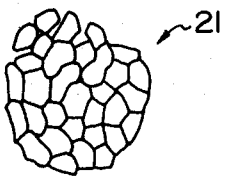
FIGS. 4 and 5 are microphotographic sketches showing in section a tight portion and a loose portion of a crimped filament yarn according to the invention.
Figure 5:
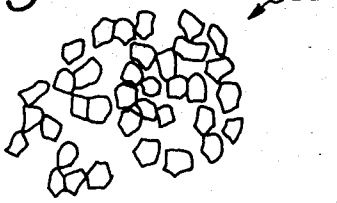

By processing a filament yarn under the above conditions, I produced a crimped filament yarn 20 with a configuration depicted in FIGS. 3–5. As shown, the crimped filament yarn 20 has an alternating distribution of first bundle portions 21 where the filaments are bound relatively tightly together in Z-twists and second portions 22 where they are bound relatively loosely in S-twists. Each of the first and second bundle portions 21 and 22 of the processed yarn 20 had a random length ranging substantially from 0.5 mm to 300 mm. Experiments showed that the length generally tends to increase in accordance with a decrease in the angles $\theta_1$ and $\theta_2$ between the belts 9 and 10 and filament yarn 3.

As seen in FIG. 4, the filaments in the first portions 21 of the processed yarn 20 are twisted densely and locally fused together. In the second portion 22 on the other hand, the filaments have a scattered and spaced distribution as viewed in FIG. 5. A presumable cause for such a configuration of the processed yarn is that one of the two twisted portions is influenced strongly by the heat of the heater 7 to be formed in the twisted and tightly bound state while the other has the filaments scattered but still kept twisted due to the twisting opposite to that of the former.

As will be noted, the S-twist portions may form the first or tight bundles and Z-twist portions the second or loose bundles depending on the processing conditions.

When a fabric prepared by knitting or weaving such crimped filament yarns 20 is dyed by an ordinary method, the tight portions 21 of each filament yarn 20 appear dark and the loose portions 22 light. It will be recalled here that the length of each continuous portion 21 or 22 is random and, hence, a delicate dark and light pattern or salt-and-pepper pattern appears evenly on the entire fabric.

Figure 6:
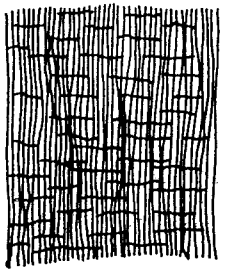
FIG. 6 depicts a pattern with dark and light shades appearing on a knitted fabric according to the invention.
Figure 7:
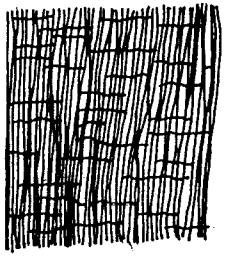
FIG. 7 shows a pattern with dark and light shades on a woven fabric according to the invention.

Concerning knitted fabrics, the salt-and-pepper pattern appears differently depending on the kind of knitting work. In the case of circular knitting work, the lengths of the dark and light portions each appear perpendicular to the knitting direction as shown in FIG. 6. In the case of warp knitting work, they appear parallel to the knitting direction. The appearance of the pattern concerned is also variable in woven fabrics. Where a crimped filament yarn 20 according to the invention is used as a warp yarn with wefts provided by usual crimped yarns, the lengths of the dark and light portions appear in the weaving direction. When crimped filament yarns 20 are used as wefts in combination with a warp yarn comprising a usual crimped filament yarn, the dark and light pattern appears perpendicular to the weaving direction. Furthermore, crimped filament yarns 20 used as both the warp and weft yarns provide a latticed pattern as shown in FIG. 7.

A fabric thus prepared by knitting or weaving has a tasteful appearance due to the distribution of the irregular salt-and-pepper pattern on the entire surface of the fabric. This type of fabric also has a crisp feeling which adds to its unique quality.

EXAMPLE I

Filament yarn 3: full-draw polyester yarn of 75de/36fil (melting point at about 220° C.)
Heater 7 temperature: 240° C.
Peripheral speed of feed rollers 6 and 6': 388.9 m/min
Peripheral speed of pull-out rollers 11 and 11': 350.0 m/min
Velocity of belts $V_1$, $V_2$: 463.64 m/min
Angles $\theta_1$, $\theta_2$: 40°
Advancing velocity component $V_Y$: 355.17 m/min
Twisting velocity component $V_T$: 298.02 m/min
Upstream tension $T_1$: 44 g
Downstream tension $T_2$: 13 g

EXAMPLE II

Filament yarn 3: partially oriented polyester yarn of 115de/36fil and additionally drawn to 75de/36fil during crimping (melting point at about 220° C.)
Heater 7 temperature: 235° C.
Peripheral speed of feed rollers 6 and 6': 330.7 m/min
Peripheral speed of pull-out rollers 11 and 11': 399.2 m/min
Velocity of belts $V_1$, $V_2$: 621.2 m/min
Angles $\theta_1$, $\theta_2$: 43.5°
Advancing velocity component $V_Y$: 450.60 m/min
Twisting velocity component $V_T$: 427.61 m/min
Upstream tension $T_1$: 37 g
Downstream tension $T_2$: 1.5 g The filament yarns were false-twisted under the respective conditions shown in Examples I and II by means of the system discussed with reference to FIG. 1. Each of the resultant crimped yarns had S- and Z-twists alternating with each other with lengths ranging substantially from 0.5 mm to 300 mm as indicated in FIGS. 3–5. Knitting or weaving such yarns and dyeing them, I produced fabrics having unique qualities and having a distribution of delicate dark and light shades of color. What is claimed is:

1. A fabric including as a component element thereof at least one crimped filament yarn having an alternating lengthwise distribution of first portions each being twisted in one direction and relatively tightly bundled and locally fused together and second portions twisted in the other direction while being bundled relatively loosely, said fabric being dyed to give said first and second portions of the yarn different shades of color.

2. A knitted fabric as claimed in claim 1, wherein the fabric consists of a plurality of filament yarns at least some of which comprise said crimped filament yarn.

3. A knitted fabric as claimed in claim 1, wherein said fabric consists of one filament yarn which is said crimped filament yarn.

4. A woven fabric as claimed in claim 1, wherein said crimped filament yarn constitutes either a warp yarn or a weft yarn.

5. A woven fabric as claimed in claim 1, wherein said crimped filament yarn constitutes each of warp and weft yarns.

6. A crimped filament yarn, comprising first portions each being twisted in one direction and relatively tightly bundled and locally fused together and second portions twisted in the other direction while being bundled relatively loosely, said first and second portions being distributed alternately along the length of the filament yarn.

7. A crimped filament yarn as claimed in claim 6, wherein each of the first and second portions of the yarn has a length substantially equal to or less than 300 mm.

8. A crimped filament yarn as claimed in claim 6, wherein said filament yarn comprises a number of filaments which in the first portions are bound densely with portions thereof fused together and, in the second portions, spaced apart from one another.

* * * * *